United States Patent [19]

Sommer

[11] Patent Number: 4,972,459

[45] Date of Patent: Nov. 20, 1990

[54] ARC-PREVENTING HIGH VOLTAGE CABLE FOR AN X-RADIATOR

[75] Inventor: Andres-Guenter Sommer, Fürth, Fed. Rep. of Germany

[73] Assignee: Siemens Aktiengesellschaft, Berlin and Munich, Fed. Rep. of Germany

[21] Appl. No.: 331,819

[22] Filed: Apr. 3, 1989

[30] Foreign Application Priority Data

Jun. 6, 1988 [DE] Fed. Rep. of Germany ... 8807359[U]

[51] Int. Cl.[5] ..... H05G 1/02; H01F 15/02; H01F 15/10

[52] U.S. Cl. ..... 378/193; 333/12; 336/175

[58] Field of Search ..... 336/175, 176, 212, 229, 336/107; 333/33, 26, 183, 12, 185; 174/75 D; 378/199, 200, 201, 202, 193

[56] References Cited

U.S. PATENT DOCUMENTS

| | | | |
|---|---|---|---|
| 2,273,538 | 2/1942 | Rogers | 174/75 D X |
| 3,191,132 | 6/1965 | Mayer | 333/79 |
| 3,462,715 | 8/1969 | Schor | 333/183 |
| 3,516,026 | 6/1970 | Curran et al. | 333/185 |
| 4,335,928 | 6/1982 | Barrett et al. | 439/519 |
| 4,575,691 | 3/1986 | Capek et al. | 333/12 |

FOREIGN PATENT DOCUMENTS

| | | | |
|---|---|---|---|
| 0267568 | 5/1988 | European Pat. Off. . | |
| 2149095 | 4/1973 | Fed. Rep. of Germany . | |
| 3015609 | 10/1980 | Fed. Rep. of Germany . | |
| 60-16404 | 1/1985 | Japan | 336/175 |
| 61-38714 | 3/1986 | Japan | 336/175 |
| 61-76626 | 5/1986 | Japan | 336/175 |
| 61-97899 | 6/1986 | Japan | 336/175 |
| 61-116021 | 7/1986 | Japan | 336/175 |
| 1523720 | 9/1978 | United Kingdom . | |

*Primary Examiner*—Thomas J. Kozma

*Attorney, Agent, or Firm*—Hill, Van Santen, Steadman & Simpson

[57] ABSTRACT

An x-ray radiator has a housing containing an x-ray tube, and having receptacles for high-voltage cables. A noise attenuating high-voltage cable has a number of ferromagnetic cores or rings which surround the cable at a location relatively close to the housing high-voltage receptacle. Noise pulses caused by high-voltage arcing in the x-ray tube are thereby attenuated, and thus do not have a significant effect on other system components, such as computer components, making the cable particularly beneficial for use in computer tomography installations.

4 Claims, 1 Drawing Sheet

ARC-PREVENTING HIGH VOLTAGE CABLE FOR AN X-RADIATOR

BACKGROUND OF THE INVENTION

1. Field of the Invention

The present invention is directed to high-voltage connectors and cables for an x-radiator of the type having a housing in which an x-ray tube is disposed.

2. Description of the Prior Art

A phenomenon known as tube surging, which is basically a high-voltage arc, occurs in the operation of an x-ray tube due to the collection of residual ions in the vacuum. Extremely high, short duration current elevations in the high-voltage cables, and displacement currents between the cable and the radiator housing, can be caused by tube surging. High-voltage arcing of this type can also generate noise pulses which are transmitted as electromagnetic waves along the high-voltage cable, with the cable functioning in the manner of an antenna. These noise pulses generate a high-energy magnetic field which may cause malfunctions or outages in nearby computer components of the installation containing the x-radiator.

SUMMARY OF THE INVENTION

It is an object of the present invention to provide a high-voltage cable for an x-radiator wherein the noise effects of high-voltage arcing are reduced.

The above object is achieved in accordance with the principles of the present invention in a high-voltage cable adapted to be connected to a high-voltage receptacle of an x-radiator, the cable having a plurality of cores or rings of ferromagnetic material disposed relatively close to the housing receptacle. The transmission antenna formed by the high-voltage cable is thereby attenuated, and the transmission of noise pulses along the cable is significantly reduced.

An especially good reduction of noise pulses is achieved in an embodiment wherein the cores are toroidal cores. It is preferable to integrate at least one of the cores in the housing of the high-voltage plug of each high-voltage cable.

DESCRIPTION OF THE PREFERRED EMBODIMENTS

Figure 1:
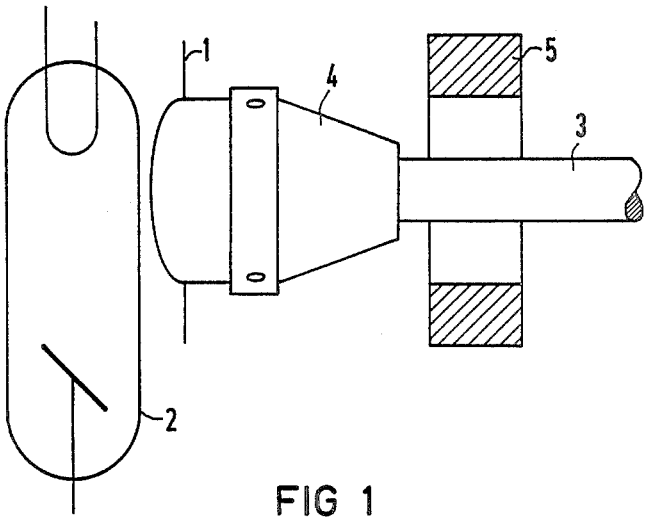
FIG. 1 is a side view, partly in section, of a first embodiment of a high-voltage cable constructed in accordance with the principles of the present invention shown in relation to the relevant components of an x-radiator.

The relevant components of an x-radiator shown in relation to a high-voltage cable constructed in accordance with the principles of the present invention are illustrated in FIG. 1. The x-radiator has a housing 1 in which an x-ray tube 2 is contained. High-voltage to the x-ray tube 2 is supplied by a high-voltage cable 3 connected at a housing receptacle 4. In accordance with the principles of the present invention, the high-voltage cable 3 is surround by a core 5 consisting of ferromagnetic material, and disposed close to the housing receptacle 4.

Figure 2:
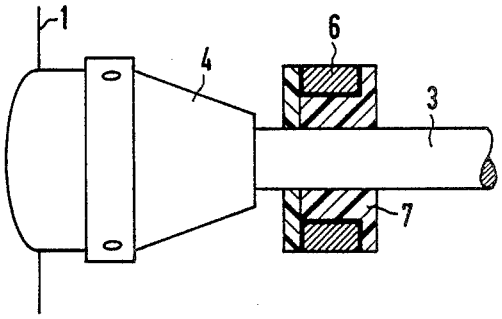
FIG. 2 is a side view, partly in section, of a second embodiment of a high-voltage cable constructed in accordance with the principles of the present invention shown in relation to the high-voltage receptacle of an x-radiator.

A further embodiment of the invention is shown in FIG. 2, wherein the x-radiator housing 1 and the high-voltage receptacle 4 and the high-voltage cable 3 are again shown. In the embodiment of FIG. 2, the high-voltage cable 3 is surrounded by a toroidal core 6 contained in a plastic mount 7. This embodiment is especially effective in suppressing noise pulses.

Figure 3:
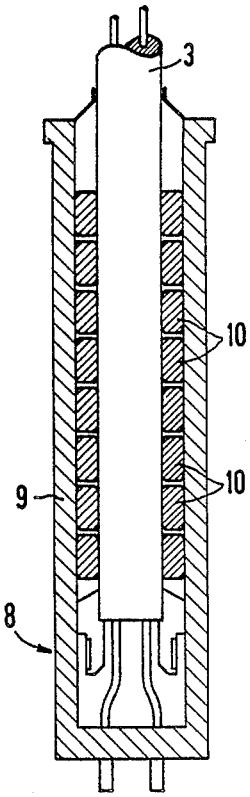
FIG. 3 is a sectional view of a third embodiment of a high-voltage cable for an x-radiator constructed in accordance with the principles of the present invention.

In the embodiment of FIG. 3, the high-voltage cable 3 has a high-voltage plug 8, which is received in the high-voltage receptacle 4 (not shown in FIG. 3). The high-voltage plug 8 has a housing 9, which surrounds a plurality of toroidal cores 10 which are coaxially disposed on the high-voltage cable 3.

Although the invention has been described above in relation to figures showing only one high-voltage cable 3 leading to the x-ray tube 2, it will be understood that in practice the housing 1 has two high-voltage receptacles for the high-voltage cables at the anode side and the cathode side. All of the high-voltage cables leading to the x-ray tube can be constructed in accordance with the principles of the present invention using cores of ferromagnetic material to attenuate noise pulses.

The noise attenuation achieved by the above cables is particularly beneficial in x-radiators used in computer tomography devices, since a number of computer components will necessarily be present nearby the x-radiator, the operation of which may be impaired by high-voltage arcing in the x-ray tube.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-radiator comprising:

a housing containing components including an x-ray tube requiring high voltage for operation, said housing having a high voltage input;

a cable having a first end connected to said high voltage input of said housing and having a second end adapted for connection to a high voltage supply; and a plurality of cores consisting of ferromagnetic material surrounding said cable and disposed at said first end of said cable for attenuating noise associated with the transmission of high voltage to said housing.

2. An x-radiator as claimed in claim 1, wherein said first end of said cable is a plug having a housing, and wherein at least one of said cores is contained in said housing of said plug.

3. An x-radiator as claimed in claim 1, wherein said cores are toroidal cores.

4. An x-radiator as claimed in claim 1, further comprising, for each core, a carrier consisting of insulating material surrounding said cable and disposed between said cable and each core.

* * * * *